US005857393A

United States Patent [19]

Kohiyama

[11] Patent Number: 5,857,393

[45] Date of Patent: Jan. 12, 1999

[54] AUTOMATIC PAPER FEEDING APPARATUS

[76] Inventor: Yuko Kohiyama, 5624-9 Tamura, Hiratsuka-shi, Kanagawa, Japan

[21] Appl. No.: 678,186

[22] Filed: Jul. 11, 1996

[30] Foreign Application Priority Data

Jun. 28, 1996 [JP] Japan ..... 8-188405

[51] Int. Cl.[6] ..... B26D 7/22

[52] U.S. Cl. ..... 83/76.1; 83/62; 83/167; 83/203; 83/649

[58] Field of Search ..... 83/76.1, 167, 62, 83/203, 649, 58, 62.1, 399, 443; 225/39, 42, 46, 47

[56] References Cited

U.S. PATENT DOCUMENTS

| | | | |
|---|---|---|---|
| 3,192,808 | 7/1965 | Fiedler et al. | 83/76.1 |
| 4,193,330 | 3/1980 | Knox | 83/205 X |
| 4,265,153 | 5/1981 | Price, Jr. | 83/205 X |
| 5,131,302 | 7/1992 | Watanabe | 83/167 |

*Primary Examiner*—M. Rachuba
*Attorney, Agent, or Firm*—Pillsbury Madison & Sutro LLP

[57] ABSTRACT

An automatic paper feeding apparatus has a holder device holding a roll form paper, a feeder device having two roller portions mutually contacting to each other for rotation in mutually opposite directions, the feeder device clamping the paper between the two rollers for feeding in a predetermined length, a cutting device having a stationary blade and a movable blade for cutting the paper, the movable blade being moved relative to the stationary blade for cutting the paper between two blades, start input means for outputting a start input signal, and a control system responsive to start input signal from the start input means to output a feeder driving output signal to the feeder device for driving. The feeder device has a feeding motor to be driven in response to the feeder driving output signal for driving and stopping the feeder motor. The cutting device including a cutter motor to be driven in response to a movable blade moving output signal output after stopping the feeder device and a cutter position sensor for stopping the cutter motor, the cutter motor driving the movable blade toward the stationary blade for cutting the paper, and stopping in response to a stop output signal output from the control system for stopping the cutter motor when the movable blade returns to an original position after cutting and thus a detection signal is output from the cutter position sensor to the control system.

5 Claims, 15 Drawing Sheets

AUTOMATIC PAPER FEEDING APPARATUS

BACKGROUND OF THE INVENTION

1. Field of the Invention

The present invention relates generally to an automatic paper feeding apparatus for feeding sanitary paper, kitchen paper and so forth. More specifically, the invention relates to an apparatus for automatically rolling out a predetermined amount of paper under electrical control.

2. Description of the Related Art

As is well known, paper holders are used in various applications. Typically, the paper holder comprises a holder device for holding a roll of paper, a feeder device for feeding out the paper and a cutting device for cutting the fed out paper. Such a conventional paper holder is manually operated.

In the prior art set forth above, since the paper holder is operated manually, the following drawbacks are inherently encountered. A physically handicapped person or a person having an injured or damaged hand, for example, may have difficulty manually rolling out the desired amount of paper. In addition, the paper is directly touched by hand to potentially cause contamination.

SUMMARY OF THE INVENTION

Therefore, it is an object of the present invention to provide a technology for automatically feeding paper which assists a physically handicapped person in rolling out paper and improves hygiene management.

According to one aspect of the invention, an automatic paper feeding apparatus comprises:

a holder device configured to hold a roll of paper;

a feeder device having two roller portions mutually contacting each other and a feeding motor operatively associated with at least one of said roller portions for rotation of said roller portions in mutually opposite directions, said feeder device being configured to clamp paper between said two rollers portions;

a cutting device having a stationary blade and a movable blade for cutting said paper and a cutter motor operatively associated with said movable blade for moving said movable blade relative to said stationary blade for cutting paper between said movable blade and said stationary blade;

start input means for outputting a start input signal;

a cutter position sensor configured to output a detection signal when said movable blade is in an open position;

a control system configured to output a feeder driving output signal to said feeder device in response to said start input signal, to output a feeder stop output signal after expiration of a selectable period, to output a movable blade moving output signal after said feeding motor is stopped, and to output a cutter stop output signal in response to said detection signal, said feeding motor being driven in response to said feeder driving output signal issued by said control system such that said feeding motor drives said roller portions to rotate, said feeding motor being stopped in response to said feeder stop output signal issued by said control system after expiration of said selectable period, said cutter motor being driven in response to said movable blade moving output signal issued by said control system after said feeder device is stopped, and said cutter motor being stopped in response to said cutter stop output signal issued by said control system, wherein the control system controls the feeding and cutting of paper to provide a selectable length of paper based upon the selectable period.

With the construction set forth above, by electrically controlling the system, a predetermined amount of paper can be easily obtained. Therefore, a device which can be conveniently used even by a physically handicapped person can be provided. Furthermore, since the portion of the paper contacted by hand is limited, a hygienically superior paper is provided.

In the preferred construction, the holder device includes a plurality of mounting rollers for mounting said roll form paper and a cover covering said paper mounted on said mounting roller, said mounting rollers being rotatable according to rotation of said paper, said cover being pivotable about a pivot point so as to be pivoted to an open position for certainly defining a space for accommodating said paper onto said mounting rollers from outside of said automatic paper feeding apparatus.

In this construction, the paper roll is not required to have a core and is set on the mounting rollers. Accordingly, the paper can be disposed in the device irrespective of rolling direction. Therefore, the paper can be set simply by mounting the paper on the mounting rollers. Furthermore, since the paper can be set on the mounting rollers by opening the cover, setting of the paper can be done with a single hand, easily.

Also, it is preferred that the cover includes a rotatable cylindrical roller, said roller contacting with said roller portion in a condition clamping said paper between said roller and said roller portion in the condition where said cover is closed, and the own weight of said roller is exerted on said roller portion.

The feeder device constructed as set forth above places the paper between the roller and the roller portion upon setting the paper in the holder device. Thereafter, by rotating the roller portion, the paper can be drawn between mutually contacting rollers to facilitate setting of the paper between the roller portions.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

A preferred embodiment of an automatic paper feeding apparatus according to the present invention will be discussed hereinafter with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail the present invention is not unnecessarily secured.

Figure 27:
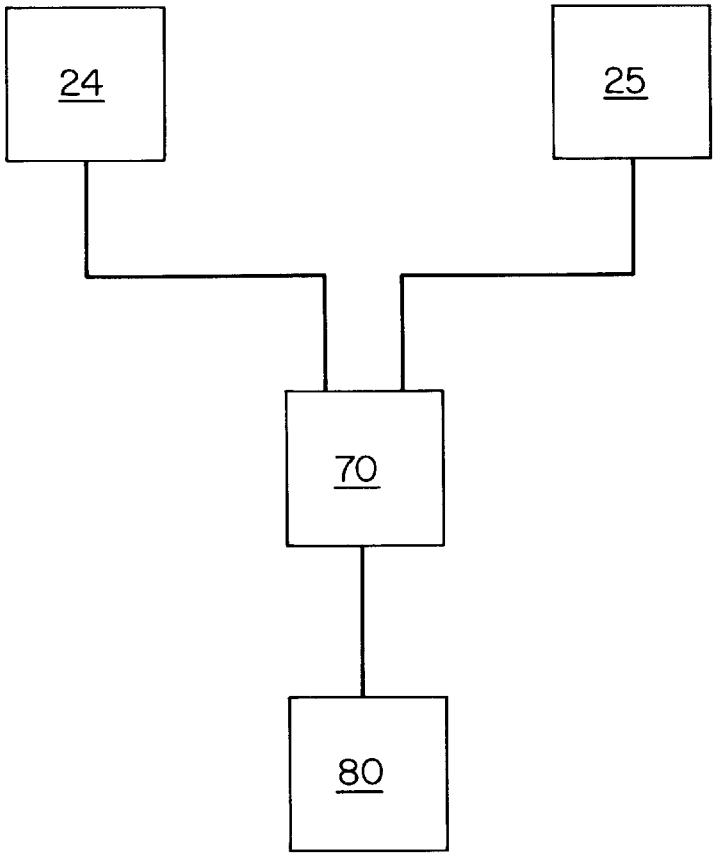
FIG. 27 is a schematic of a control system in the preferred embodiment of an automatic paper feeding apparatus according to the present invention.

The preferred embodiment of an automatic paper feeding apparatus includes a holder device 10, a feeder device 20, a cutting device 30, a control system 70 and a power source unit 80 (as shown in FIG. 27). Discussion for respective components will be given hereinafter.

Figure 4:
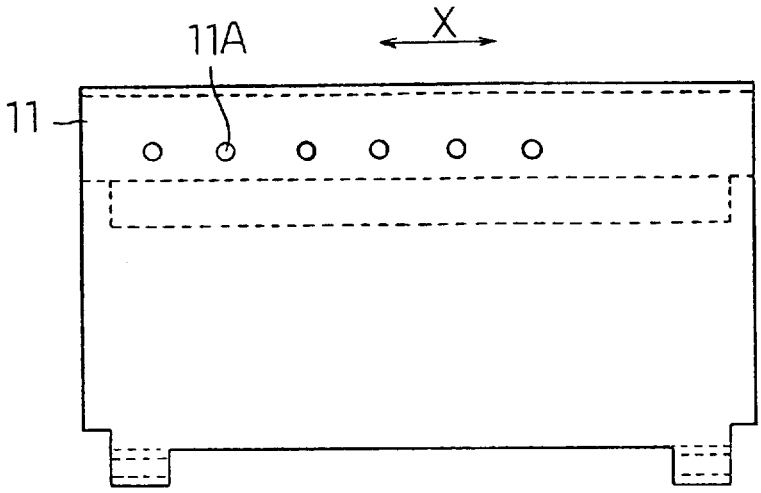
FIG. 4 is a plan view of a cover in the preferred embodiment of an automatic paper feeding apparatus according to the present invention.
Figure 5:
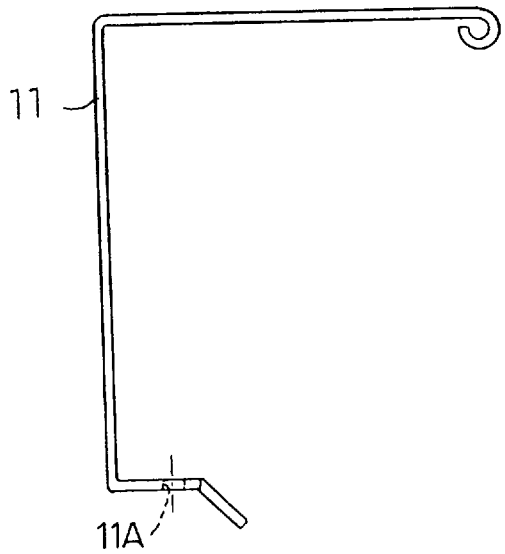
FIG. 5 is a right side elevation of the cover in the preferred embodiment of an automatic paper feeding apparatus according to the present invention.
Figure 6:
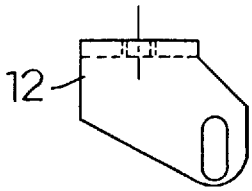
FIG. 6 is a right side elevation of a roller holding member in the preferred embodiment of an automatic paper feeding apparatus according to the present invention.
Figure 7:
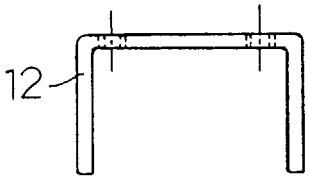
FIG. 7 is a front elevation of the roller holding member in the preferred embodiment of an automatic paper feeding apparatus according to the present invention.
Figure 8:
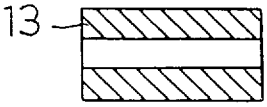
FIG. 8 is a section of the roller in the preferred embodiment of an automatic paper feeding apparatus according to the present invention.
Figure 10:
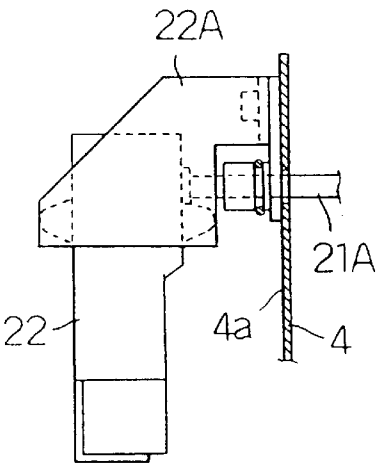
FIG. 10 is an illustration showing a feed motor in the preferred embodiment of an automatic paper feeding apparatus according to the present invention.

The holder device 10 includes a cover 11. At one end of the cover 11, a channel-shaped roller holding member 12 (see FIGS. 6 and 7) is fixed. With respect to the roller holding member 12, a roller 13 is rotatably mounted. A drawing device 27, which is discussed later, comprises roller 13 and roller 21 (as shown in FIG. 4). In the cover 11, a plurality of mounting holes 11 is formed along a left and right direction X in order to fix the roller holding member 12. With this configuration, the position of the roller 13 mounted on the roller holding member 12 can be adjusted to the desired position in the left and right direction X. By this, the holder device 10 can be adapted to various widths of paper.

Figure 2:
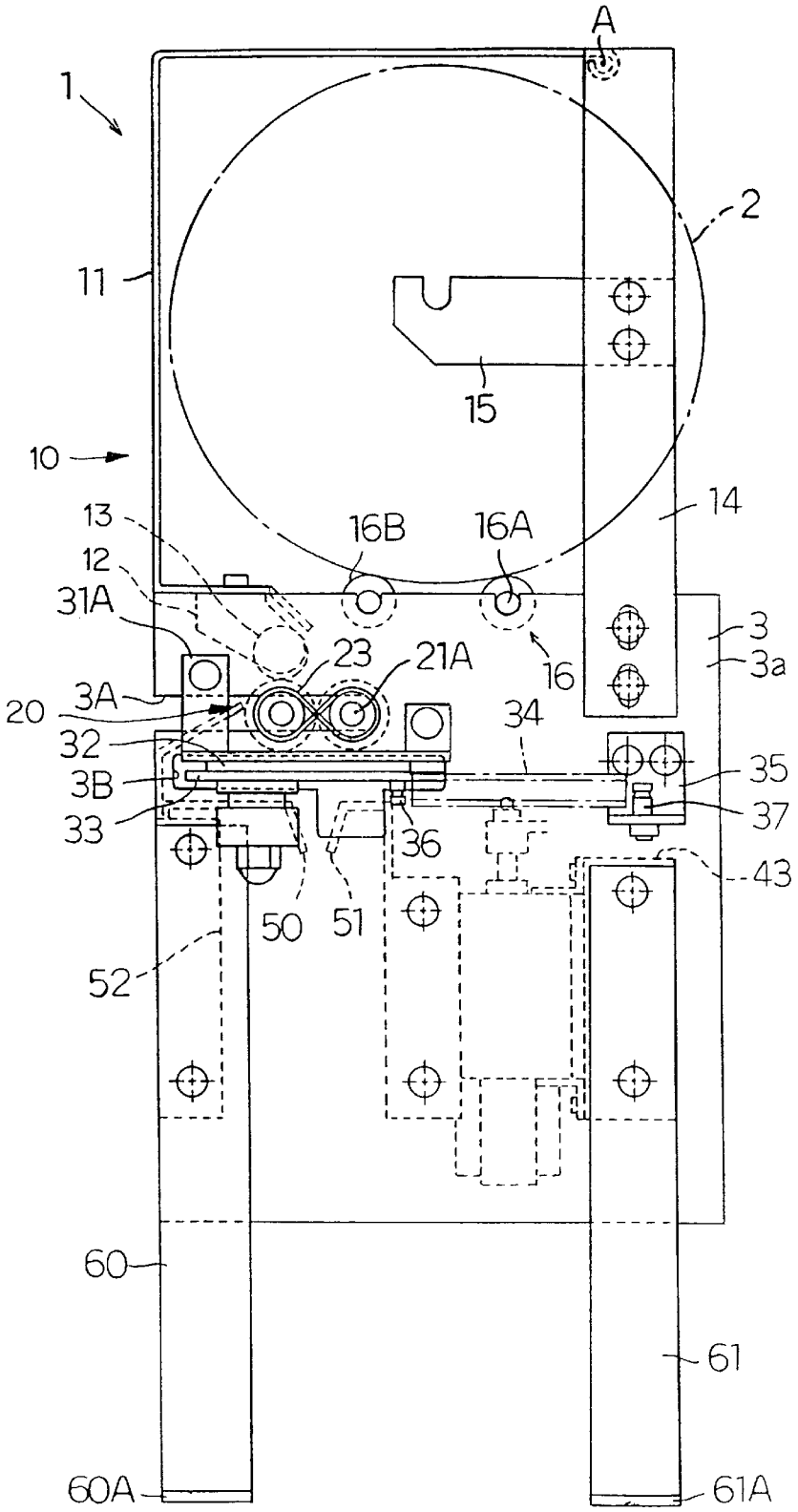
FIG. 2 is a right side elevation of the preferred embodiment of an automatic paper feeding apparatus according to the present invention.
Figure 3:
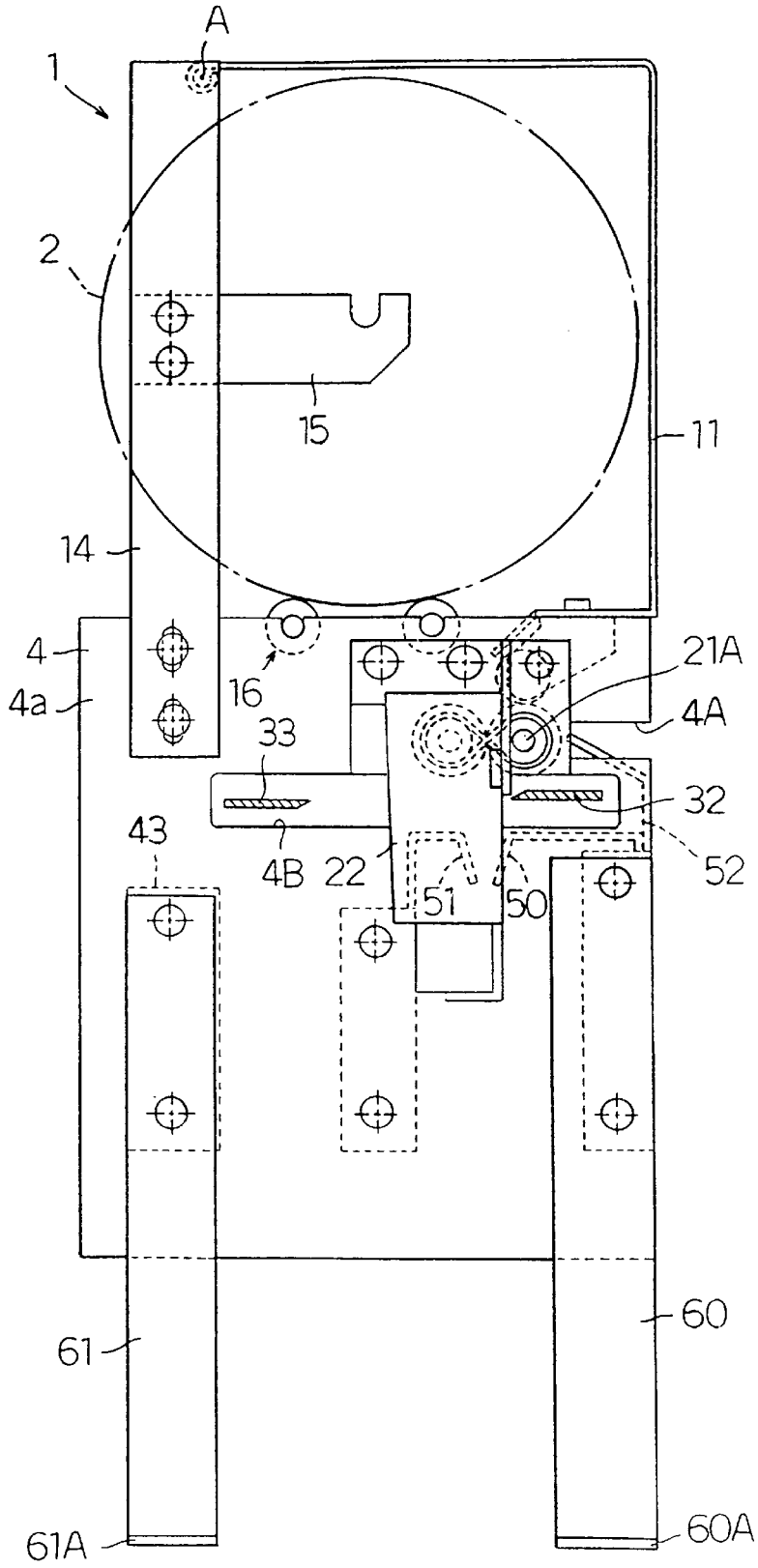
FIG. 3 is a left side elevation of the preferred embodiment of an automatic paper feeding apparatus according to the present invention.

As shown in FIG. 2, the other end portion of the cover 11 is pivotably mounted on left and right brackets 14, such that cover 11 is pivotable about point A. Two pins secure the cover 11 to the brackets 14. The cover 11 can be pivoted about a pivot point A to allow opening of the front side of the automatic paper feeding apparatus 1 and allow access to a space for accommodating the paper 2 inside of the holder device 10. The left and right brackets 14 are respectively fixed to the left and right side plates 3 and 4 and are configured for permitting adjustment of mounting height. Accordingly, the holder device 10 can be adapted to accommodate paper rolls having different diameters.

The holder device 10 has a paper holding member 15 for holding the roll form paper 2 from both left and right sides. The paper holding member 15 is fixed to the brackets 14 and is positioned both to be disposed on the left and right sides of the paper 2.

Figure 9:
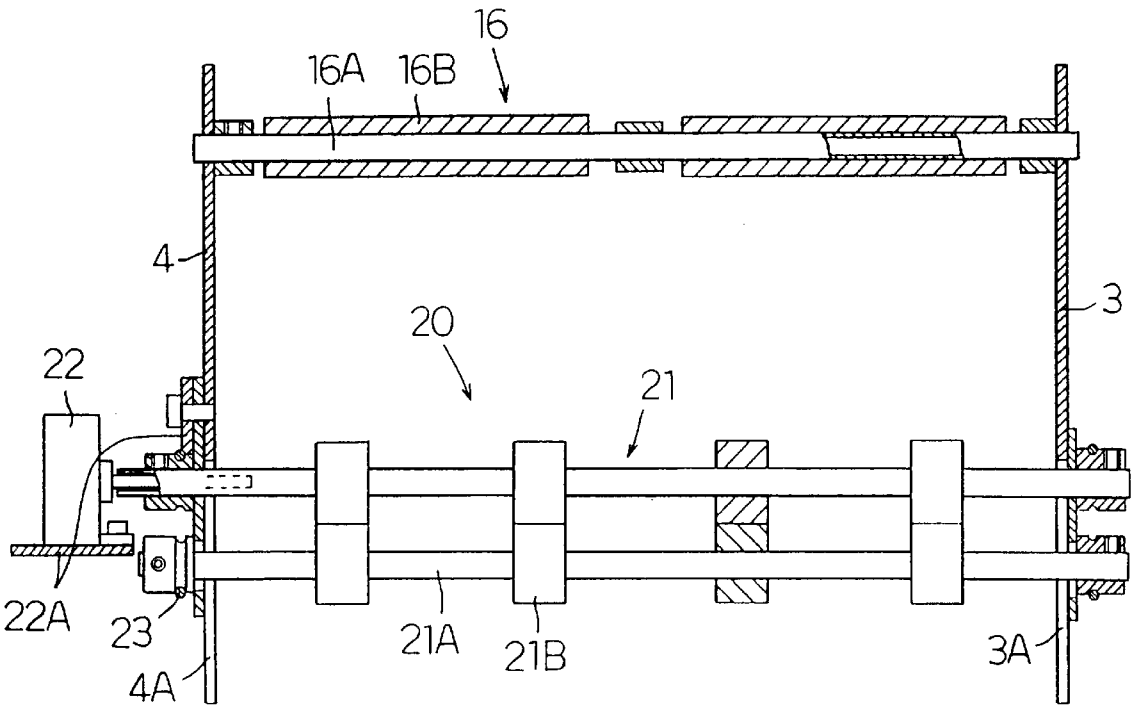
FIG. 9 is a partially sectioned plan view of a mounting roller and a roller portion in the preferred embodiment of an automatic paper feeding apparatus according to the present invention.

The holder device 10 also has two mounting rollers 16 for mounting the roll form paper 2. Each of the mounting rollers 16 has a shaft 16A and a bearing portion 16B fixed on the periphery of the shaft 16A (see FIG. 9). The paper 2 is mounted on the receptacle portion 16B. The mounting rollers 16 are constructed rotatably. When the paper is rotated, the mounting rollers 16 rotate correspondingly.

The feeder device 20 includes two roller portions 21. Each of the roller portions 21 includes a shaft 21A positioned between slits 3A and 4A formed in the left and right side plates 3 and 4, and a plurality of rubber rollers 21B arranged in spaced relationship on the periphery of the shafts 21A (see FIG. 9). Respective rubber rollers 21B of two roller portions 21 contact each other. When the paper 2 is installed in the device, the paper 2 is clamped between the rubber rollers 21B in contact with each other.

A feeding motor 22 is coupled to one of the shafts 21A transmitting a revolution force to this shaft. The feeding motor 22 is fixed to an outside surface 4*a* of the right side plate 4 by means of a motor holding member 22A. The shaft 21A of the roller portion 21 connected to the motor 22 is connected to the shaft portion 21A of the other roller portion 21 by means of a rubber belt 23 wound in an intersecting manner. With this configuration, the rubber rollers 21B in respective shafts 21A rotate at the same speed in mutually opposite directions to pull the paper 2 downwardly.

Figure 1:
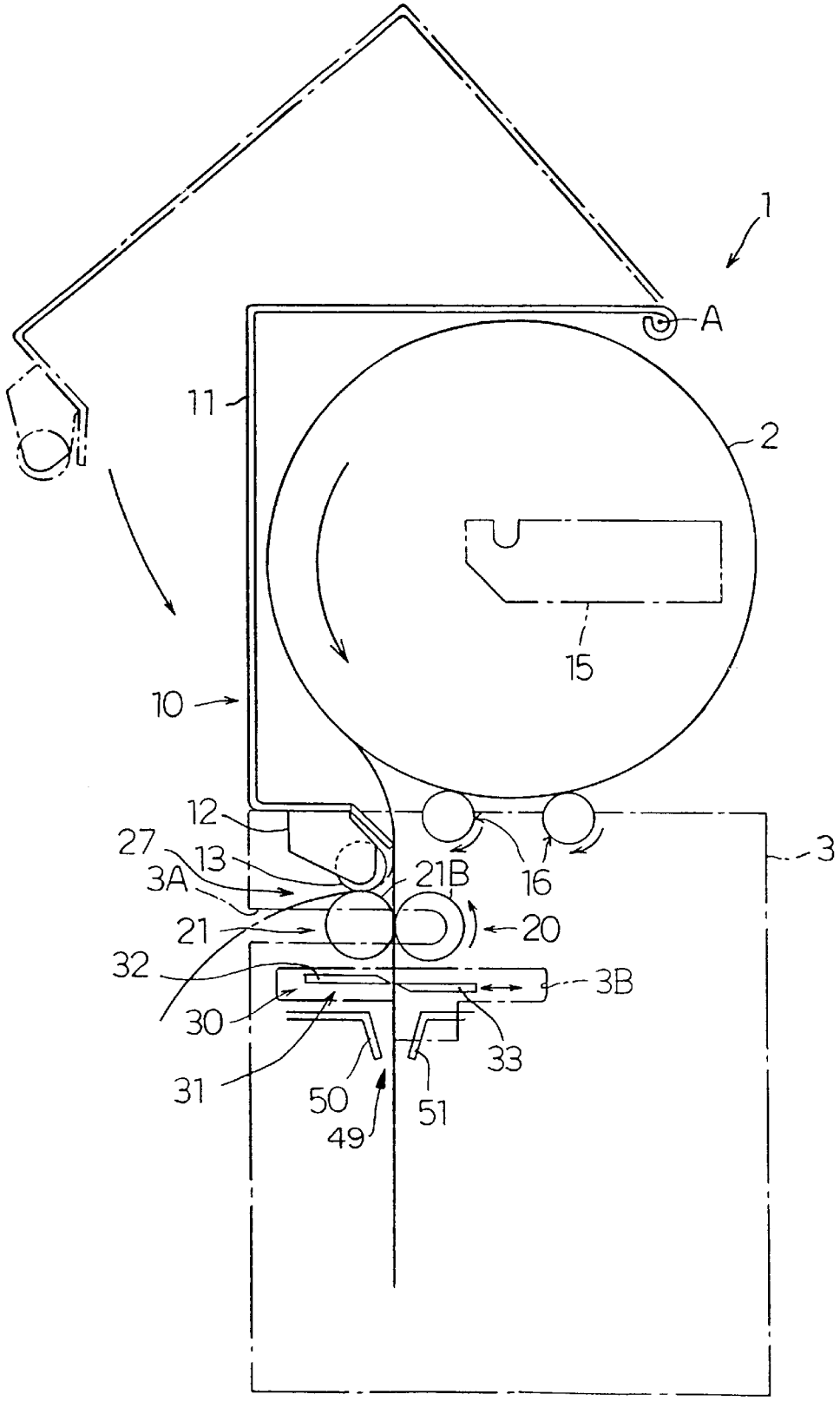
FIG. 1 is a right side elevation showing general construction of the preferred embodiment of an automatic paper feeding apparatus according to the present invention.

As shown in FIG. 1, the other roller portion 21 is the portion forming the drawing device 27 together with the roller 13. The rubber roller 21B of this roller portion 21 and the roller 13 contact each other by the own weight of the roller 13.

The feeding motor 22 is controlled by a control system (discussed later) so that a feeding length of the paper 2 can be adjusted by a rotating period of the roller portion 21. The period is settable at four steps in the control system, and settable for two steps by a selection button 24 (see FIG. 27) mounted on the automatic paper feeding apparatus 1, and thus can be set within a range of eight steps. The selection button 24 allows selection between "normal length" and "double length" and can be operated manually. This selecting button also serves as a start button for feeding the paper 2.

As set forth, when the paper 2 of the normal length is desired to be obtained, the selection button for "normal length" is pushed. The start button of the automatic paper feeding apparatus 1 could also include a start sensor (not shown) for detecting a hand placed in proximity to the automatic paper feeding apparatus 1. For example, the start sensor is mounted on either the left or right side plates 3 and 4 of the automatic paper feeding apparatus 1. When the hand is placed in proximity of one of the side plates 3 and 4 of the automatic paper feeding apparatus, the "normal length" can be selected without touching the device.

The cutting device 30 includes a cutter 31. The cutter 31 includes a stationary blade 32 and a movable blade 33. The movable blade 33 rotates about the pivot point B (see FIGS. 11 and 14). Namely, the paper 2 is cut by clamping between the stationary blade 32 and the movable blade 33. At the outer surface 3*a* of the left side plate 3, a cutter bracket 31A is fixed. With respect to the cutter bracket 31A, the stationary blade 32 is fixed by a screw. Thus, the stationary blade 33 is fixed on the outer surface 3*a* of the left side plate 3 by a screw so that the stationary blade can be easily removed for improving maintenance ability. The movable blade 33 is mounted for pivoting about the pivot point B relative to the stationary blade 32. Furthermore, the stationary blade 32 and the movable blade 33 extend through a window portion 3B formed in the left side plate 3 to the right side plate 4. The tip ends of the stationary blade 32 and the movable blade 33 are positioned within a window portion 4B formed in the right side plate 4 so as not to contact with the right side plate 4.

Figure 11:
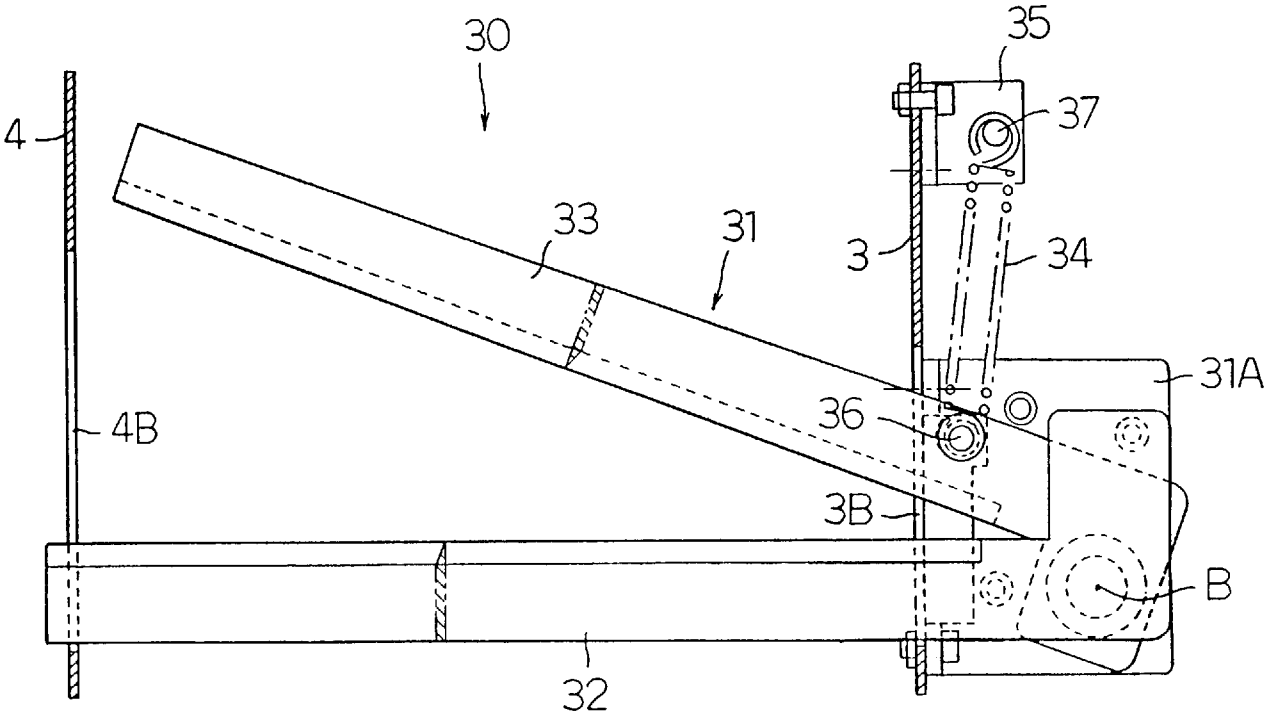
FIG. 11 is a plan view of a cutter including a spring, in the preferred embodiment of an automatic paper feeding apparatus according to the present invention.
Figure 12:
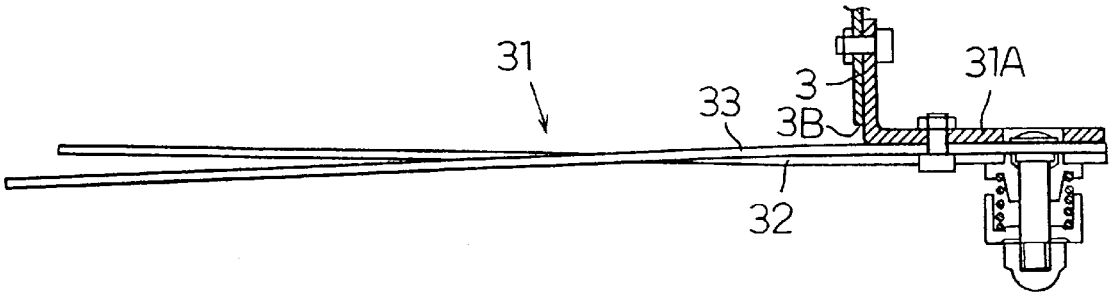
FIG. 12 is a plan view of the cutter in the preferred embodiment of an automatic paper feeding apparatus according to the present invention.
Figure 13:
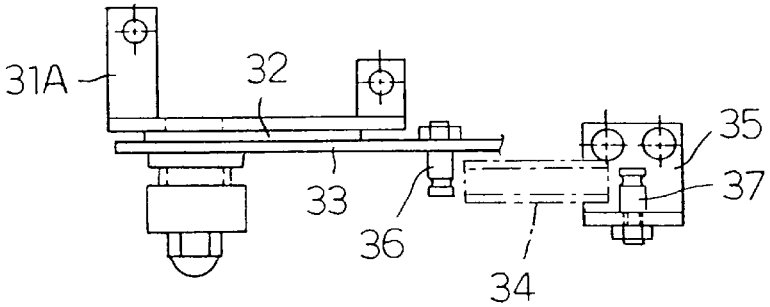
FIG. 13 is a left side elevation of the cutter including the spring, in the preferred embodiment of an automatic paper feeding apparatus according to the present invention.

With reference to FIGS. 11 to 13, the movable blade 33 is pulled by a spring 34 such that the movable blade 33 is wedged away from the stationary blade 32. On the left side plate 3, a spring bracket 35 is fixed. A spring hook 37 is fixed on the spring bracket 35. Another spring hook 36 is fixed on the movable blade 33. The spring 34 is fixed to the spring hook 36 at one end and to the spring hook 37 at the other end.

Figure 15:
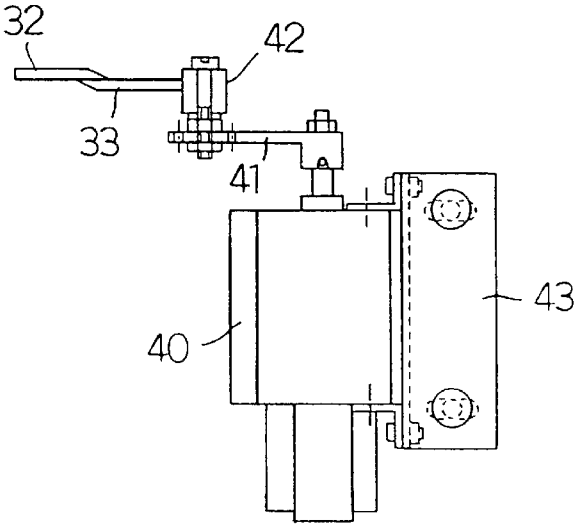
FIG. 15 is a left side elevation of the cutter including the cutter motor, in the preferred embodiment of an automatic paper feeding apparatus according to the present invention.
Figure 14:
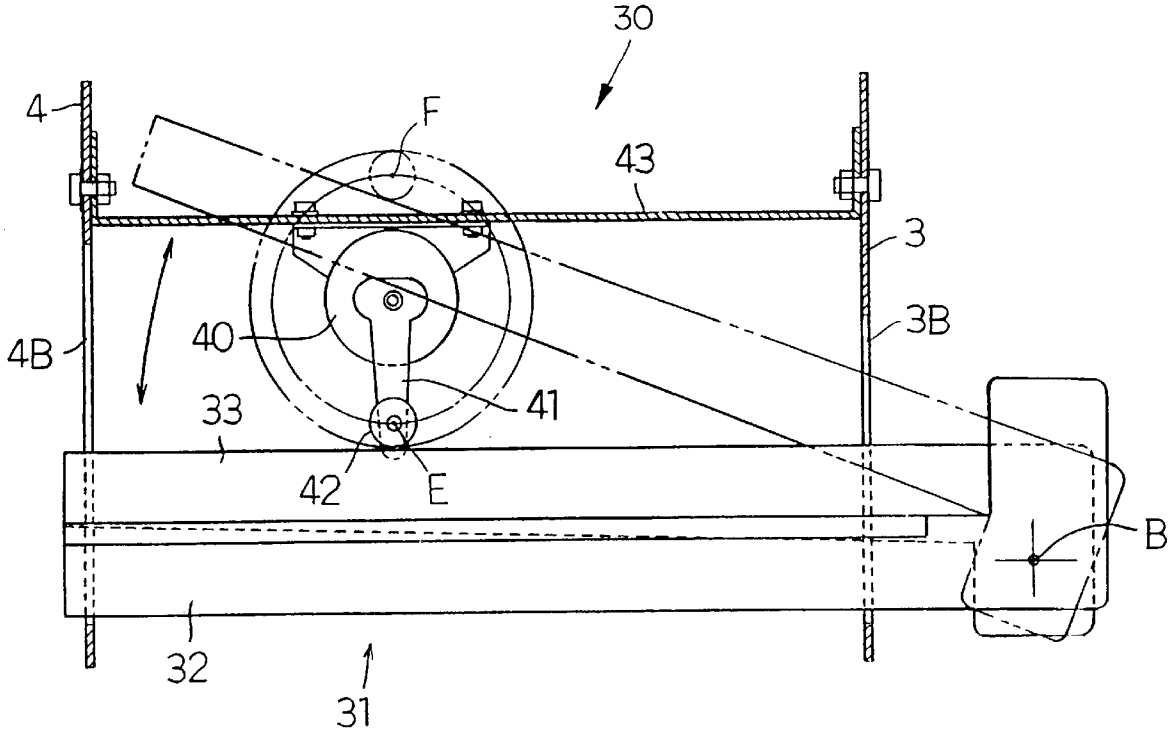
FIG. 14 is a plan view of the cutter including a cutter motor, in the preferred embodiment of an automatic paper feeding apparatus according to the present invention.
Figure 16:
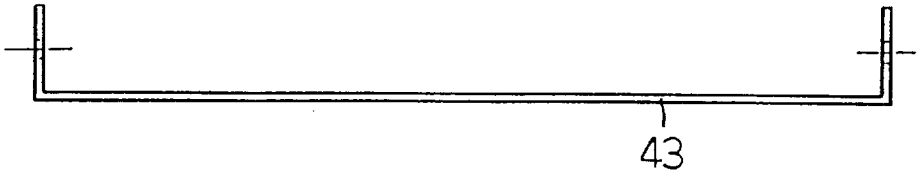
FIG. 16 is a plan view of a motor bracket in the preferred embodiment of an automatic paper feeding apparatus according to the present invention.
Figure 17:
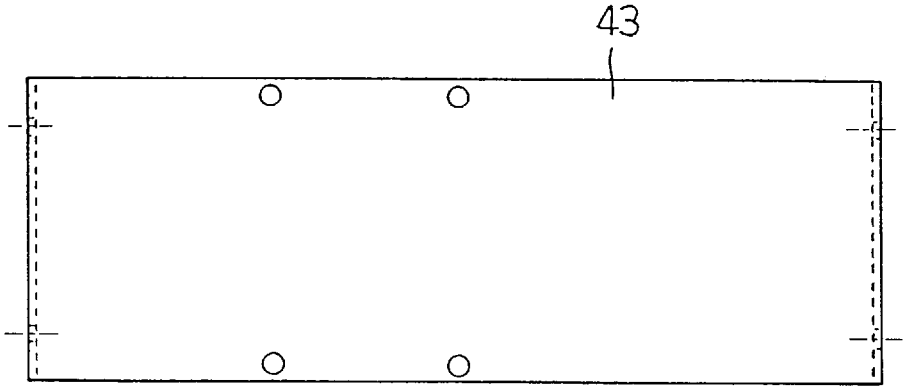
FIG. 17 is a front elevation of the motor bracket in the preferred embodiment of an automatic paper feeding apparatus according to the present invention.
Figure 18:
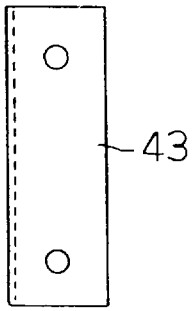
FIG. 18 is a left side elevation of the motor bracket in the preferred embodiment of an automatic paper feeding apparatus according to the present invention.
Figure 19:
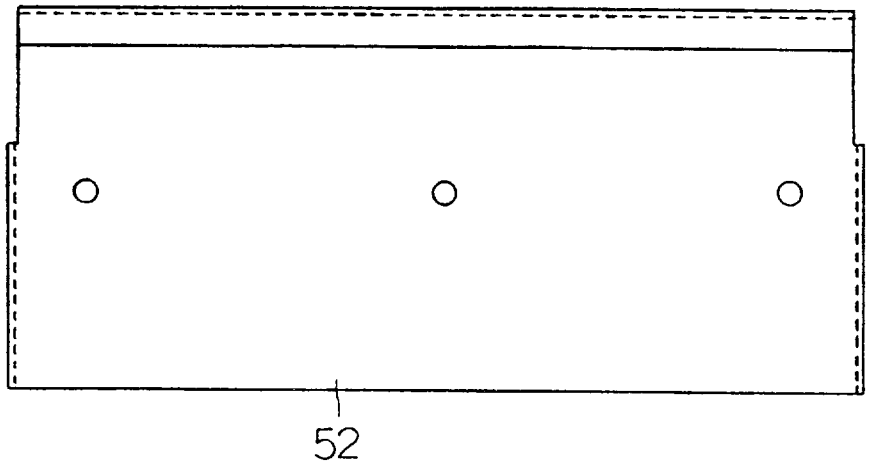
FIG. 19 is a front elevation of a guide plate in the preferred embodiment of an automatic paper feeding apparatus according to the present invention.
Figure 20:
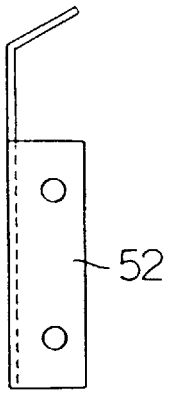
FIG. 20 is a left side elevation of the guide plate in the preferred embodiment of an automatic paper feeding apparatus according to the present invention.
Figure 21:
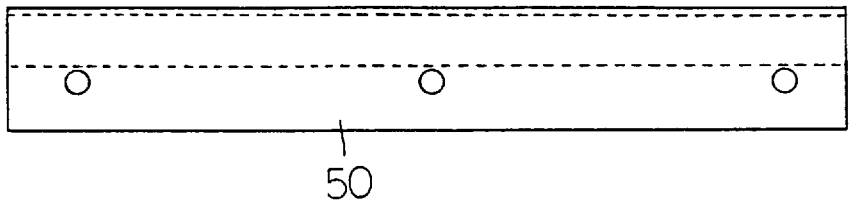
FIG. 21 is a front elevation of a front side guide plate in the preferred embodiment of an automatic paper feeding apparatus according to the present invention.
Figure 22:
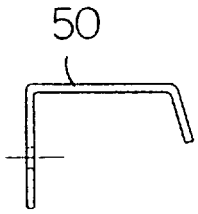
FIG. 22 is a left side elevation of the front side guide plate in the preferred embodiment of an automatic paper feeding apparatus according to the present invention.
Figure 23:
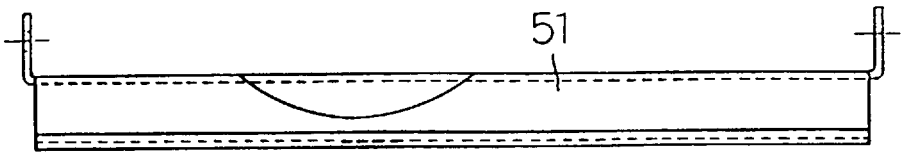
FIG. 23 is a plan view of a rear side guide plate in the preferred embodiment of an automatic paper feeding apparatus according to the present invention.
Figure 24:
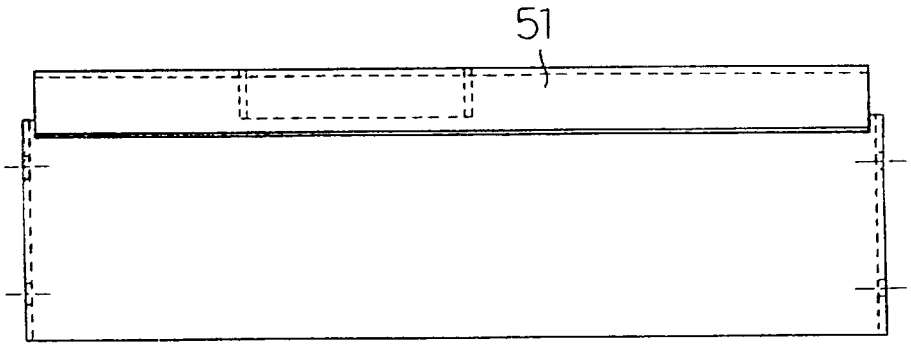
FIG. 24 is a front elevation of the rear side guide plate in the preferred embodiment of an automatic paper feeding apparatus according to the present invention.
Figure 25:
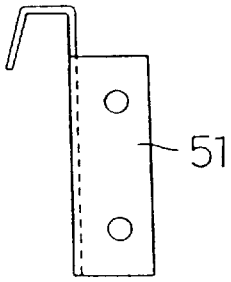
FIG. 25 is a left side elevation of the rear guide plate in the preferred embodiment of an automatic paper feeding apparatus according to the present invention.

As shown in FIGS. 14 and 15, the movable blade 33 is constructed to close toward the stationary blade 32. For this purpose, a cutter motor 40 is provided. The cutter motor 40 is connected to a crankshaft 41. A rotary pushing portion 42 is provided at a tip end of the crankshaft 41. The cutter motor 40 is fixed to a motor bracket 43 (see FIGS. 2, 3, 16, 17 and 18) which is, in turn, fixed between the left and right side plates 3 and 4. The crankshaft 41 is rotated by an output of the cutter motor 40 at a speed reduced by a gear box. The rotary pushing portion 42 is rotatably supported at the tip end portion of the crankshaft 41 for pushing the movable blade 33 from the back surface.

When the crankshaft 41 is rotated and the movable blade 33 is pushed toward the stationary blade, the paper 2 clamped between the stationary blade 32 and the movable blade 33 is cut. Then, by further rotation of the crankshaft 41, the movable blade 33 is released away from the stationary blade 32 by the action of the spring 34.

The cutting device 30 has a cutter position sensor (not shown) for detecting the position of the movable blade 33. The position sensor is adapted to feed a stop signal to the cutter motor 40 when the rotary pushing portion 42 reaches a stop position F located in opposition of a cutting position E.

A guide plate assembly 49 is located below the cutter 31. The guide plate assembly 49 is adapted to appropriately determine the position of the depending paper 2. The guide plate assembly includes a front side guide plate 50 and a rear side guide plate 51. The front side guide plate 50 is fixed to a guide plate 52 (see FIGS. 2, 3, 19 and 20) fixed between the left and right side plates 3 and 4 (see FIGS. 2, 3, 21 and 22). The rear side guide plate 51 is fixed between the left and right side plates 3 and 4 (see FIGS. 2, 3, 23, 24 and 25).

The automatic paper feeding apparatus 1 includes front side mounting legs 60 fixed to the front sides of the left and right side plates 3 and 4 and rear side mounting legs 61 fixed to the rear ends of the left and right side plates 3 and 4. The front and rear mounting legs 60 and 61 are formed with flange portions 60A and 61A, respectively. It should be noted that the automatic paper feeding apparatus 1 is preferably constructed to define only a 6 mm gap at the maximum so that a finger cannot enter within the apparatus, as assembled.

Next, discussion will be given for the control system. The shown embodiment of the automatic paper feeding apparatus 1 is managed under control by a computer. The control system controls driving of the feeding and cutting devices set forth above and outputs various signals.

Input signals for the control system are an input signal (start input signal) from the selection button, a remaining paper amount input signal (near end input signal) from a sensor (not shown) detecting remaining amount of paper 2, an input signal from an optional auxiliary paper stacking device (discussed below), an input signal from the cutter position sensor 25 (see FIG. 27), a paper length selection input signal from means for measuring a feed period of the paper, and an external input signal.

The sensor (not shown) detecting the remaining amount of the paper 2 is mounted at an appropriate position, such as within the holder device 10 or so forth. An auxiliary paper stacking device (not shown) can be provided together with the automatic paper feeding apparatus 1. From this auxiliary paper stacking device, a signal indicative of the remaining amount of auxiliary paper or an alarm signal is input to the control system. Therefore, in the automatic paper feeding apparatus 1 and the auxiliary paper stacking device, a communication function for wired or radio communication is provided.

The control system receiving various input signals as set forth above performs a process corresponding to respective input signals. When the start input signal is input from the selection button, the control system outputs a feeder driving output signal to the feeder device 20 for driving the feeder device 20 for feeding out the paper 2. When a paper length selection input signal indicative of a feeding period is input, the control system outputs a feeder stop output signal for the feeder device 20 for stopping the latter. Subsequently, the control system outputs a flexible teeth motion output signal to the cutting device 3 for driving the cutting device 30. When the input signal (detection signal) from the cutter position sensor is input to the control system, the control system outputs a stop output signal with respect to the cutter motor 40 for stopping the cutter motor 40.

When the remaining amount input (near end input) signal is input to the control system, the control system outputs a signal for alarm display. The alarm display is performed by turning ON a red lamp provided on the automatic paper feeding apparatus 1, for example. When an input signal from the auxiliary paper option is input to the control system, the control system also outputs the output signal for alarm display. This alarm display indicates remaining amount of the auxiliary paper or other emergency condition. The control signal selects the kind of alarm display depending upon the kind of the input signal from the option. Also, when an external input signal is input to the control system, the control system outputs corresponding output signals. It should be noted that power ON/OFF display is done preferably by a green lamp provided on the automatic paper feeding apparatus 1.

Next, discussion will be given for the power source unit (not shown). The power source unit has an adapter for supplying an alternating current or a direct current, selectively, and thus is applicable for various applications. Furthermore, the power source unit has a low voltage secondary circuit to avoid an accidental electrical shock. Also, as set forth above, the shown automatic paper feeding apparatus 1 is facilitated by employing a computer and can be adapted to the manner of use by the user.

Figure 26:
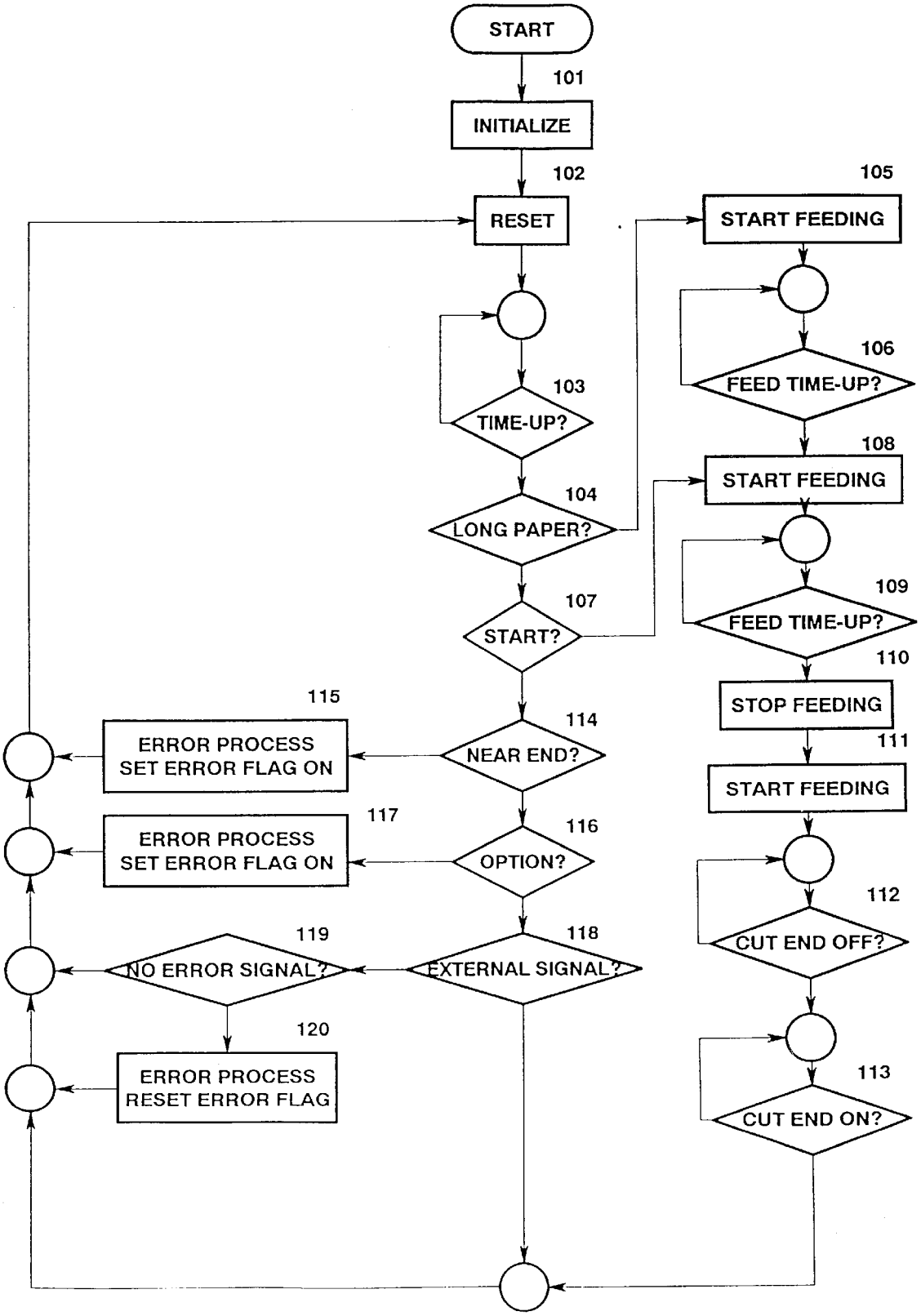
FIG. 26 is a flowchart of a control system in the preferred embodiment of an automatic paper feeding apparatus according to the present invention.

Next, the process of control to be executed by the control system will be discussed hereinafter with reference to the flowchart of FIG. 26. At first, the initial setting of the selection button (start button) or the start sensor is read out as feed time of the paper 2 (step 101). Next, all of the outputs of the automatic paper feeding apparatus 1 are reset (step 102). Next, the system enters into a waiting state for a given period to wait for measuring and judgment of respective sensors (step 103). Thereafter, process enters into a loop for waiting for input from the selection button and error judgment (step 104). When selection for the longer paper 2 is detected as checked at step 104, the input signal indicative of selection of the longer paper is input to the control system. Then, the control system outputs the output signal for driving the feeder device 20 for starting feeding (step 105). At this time, since a longer period is required for rolling out the paper 2 for the selected longer length, the feeder device 20 is driven for a longer period. Next, the control system makes a judgment whether the set period for the longer paper 2 has expired or not (step 106). When the set period is expired, an output signal for driving the feeder device 20 is output (step 108).

When the selection button for selecting the longer paper 2 is not operated as checked at the step 104, a judgment is made whether the start button or start sensor is input (step 107). When the input is detected at step 107, the control system outputs the output signal for driving the feeder device 20 (step 108). Then, the control system makes a judgment whether a feed period is expired or not (step 109). Next, when the feed period is expired, the control signal outputs a signal for stopping the feeder device 20 (step 110). Subsequently, a signal for driving the cutting device 20 is output (step 111). Thereafter, a judgment is made whether the movable blade 33 is moved to the position for cutting the paper 2 (step 112). Then, a judgment is made whether the movable blade 33 is returned to the open position and stopped (step 113). Next, the process is returned to step 102 from step 113.

If there is no input at step 107, a judgment is made whether the input of the paper remaining amount (near end input) is present or not (step 114). When the input is present as checked at step 114, the output corresponding to the input is output (step 115). Then, the process is returned to step 102. Then, a judgment is made whether input detected at step 114 is the option input or not (step 116). When input is present as checked at step 116, the output corresponding to the input is output (step 117). Thereafter, the process is returned to step 102. On the other hand, if there is no input as checked at step 116, further check is performed whether the external signal input is present or not (step 118). If there is no input as checked at step 118, check is performed whether the error signal is input or not (step 119). If not, the process is returned to step 102. On the other hand, when the error signal is present as checked at step 119, the error process is performed at step 120. Thereafter, process is returned to step 102.

The manner of use and operation of the automatic paper feeding apparatus constructed as set forth above, will be discussed. At first, the cover 11 is opened to open the front side of the automatic paper feeding apparatus 1. At this time, the opened cover 11 is held in place by a magnet or so forth. Then, the roll form paper 2 is placed on the mounting rollers 16. The roll form paper 2 is sanitary paper, kitchen paper or so forth. When the paper 2 is placed on the mounting rollers 16, the paper 2 may be rolled in either direction. By this, the paper 2 can be set on the mounting roller 16 without paying attention to the rolling direction of the paper. Also, various widths of the paper 2, such as 150 mm width, 115 mm width and so forth, can be used.

Next, the cover 11 is closed after rolling out 20 cm to 30 cm of paper 2. At this time, the rolled out paper 2 is placed in clamped condition between the roller 13 and the rubber roller 21B of the other roller portion 21. Next, after confirming turning ON of a green lamp indicating turning ON of the power source, the selection button serving as start button is depressed. In the alternative, a user's hand is placed above the start sensor to activate the automatic paper feeding apparatus 1.

Next, either by the start button or start sensor, the feeder device 20 is driven. Due to the weight of the roller 13 against the paper and corresponding roller portion 21B, the-paper 2 is drawn into and between the two roller portions 21. Subsequently, the feeder device 20 is driven to feed the paper 2 for the selected period.

Once feeding of the paper 2 for the selected period is completed, driving of the feeder device 20 is terminated to stop feeding of the paper. Thereafter, the cutting device 30 is driven to cut the paper 2. In more detail, the cutter motor 40 is driven to rotatingly drive the crankshaft 41. Then, by rotation of the crankshaft 41, the rotary pushing portion 42 pushes the movable blade 33 toward the stationary blade 32 to reach the cutting position E. The paper 2 is clamped and cut between the stationary blade 32 and the movable blade 33 to obtain the selected length of the paper.

Even after cutting of the paper 2, the cutter motor 40 is continuously driven. Then, the rotary pushing portion 42 reaches the stop position F. When the rotary pushing portion 42 reaches the stop position F, the cutter position sensor 42 acts to stop the cutter motor 40. At this time, the movable blade 33 is placed in an open position relative to the stationary blade 32 to be ready for next cutting operation. Then, the selected length of the paper 2 as cut is discharged through a discharge opening positioned at lower portion of the automatic paper feeding apparatus.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An automatic paper feeding apparatus having an automatic paper loading feature, said paper feeding apparatus comprising:

a supporting member;

a holder device disposed on the supporting member, the holder device including a pair of supporting cylindrical rollers disposed on the supporting member in a spaced, parallel relationship, the holder device being configured to support a roll of paper by engaging an outer periphery of the roll of paper;

a feeder device disposed on the supporting member below the holder device, the feeder device including a pair of engaged cylindrical rollers configured to grip paper between the cylindrical rollers and to feed the paper when the rollers are driven;

a feeder motor interconnected to the feeder device, the feeder motor driving the pair of engaged cylindrical rollers when activated;

a cutter device disposed on the supporting member below the feeder device, the cutter device including a stationary blade and movable blade movable relative to the stationary blade, the cutter device being configured to cut the paper; and a cover pivotally disposed on the supporting member, the cover and the supporting member defining a receptacle for the roll of paper, wherein access to the receptacle is provided when the cover is pivoted to an open position, the cover including a roller rollably disposed on an end of the cover such that the cover roller engages one of the pair of engaged cylindrical rollers when the cover is pivoted to a closed position, wherein the paper feeding apparatus provides automatic paper loading when a lead end of the roll of paper supported on the holder device is draped over the feeder device and the cover is pivoted to the closed position such that the cover roller engages the feeder device thereby gripping the lead end of the roll of paper between the cover roller and the feeder device, wherein the engagement of the cover roller onto the lead end of the roll of paper keeps the lead end of the roll of paper in contact with the feeder device and allows the feeder device to draw the lead end of the roll of paper into the feeder device when the feeder motor activates the feeder device.

2. An automatic paper feeding apparatus according to claim 1, wherein the supporting member includes a pair of spaced, parallel plates, each of the plates includes a slit for receiving ends of the engaged cylindrical rollers, and wherein each of the engaged cylindrical rollers includes a shaft portion and a rubber roller portion disposed on an outer periphery of the shaft portion, the shaft portions being disposed in the slits.

3. An automatic paper feeding apparatus according to claim 2, further comprising a rubber belt disposed over the shaft portions of the engaged cylindrical rollers in an intersecting manner such that the engaged cylindrical rollers are rotated at the same speed in mutually opposite directions by the feeder motor to pull the paper downwardly.

4. An automatic paper feeding apparatus according to claim 1, further comprising a control system for controlling the operation of the feeder motor and the cutter device, the control system outputting a drive signal for driving the feeder motor, outputting a stop signal after a predetermined period for stopping the feeder motor, and after outputting the stop signal, outputting a cutter signal to activate the cutter device.

5. An automatic paper feeding apparatus according to claim 4, further comprising a position sensor for detecting a position of the movable blade and for outputting a cutter detection signal when the movable blade returns to an original position after cutting.

* * * * *